United States Patent [19]

Faini

[11] Patent Number: 4,790,148

[45] Date of Patent: Dec. 13, 1988

[54] RING SHANK

[76] Inventor: Gerard Faini, 2519 W. 8th St., P.O. Box 926, Sioux Falls, S. Dak. 57101

[21] Appl. No.: 130,942

[22] Filed: Dec. 10, 1987

[51] Int. Cl.[4] ..... A44C 9/00

[52] U.S. Cl. ..... 63/15.7; 24/589

[58] Field of Search ..... 24/681, 634, 635, 636, 24/116 A, 539, 589, 662, 684; 63/15.7, 15, 15.5; 70/456 R, 459

[56] References Cited

U.S. PATENT DOCUMENTS

| | | | |
|---|---|---|---|
| 263,935 | 9/1882 | Melendy | 63/15.5 X |
| 2,543,933 | 3/1951 | Pommier | 24/636 |
| 2,771,753 | 11/1956 | Sallan | 63/15.7 |
| 3,000,658 | 9/1961 | Sprouse | 24/589 X |
| 3,566,616 | 3/1971 | Benedict, Jr. | 63/15.7 |
| 3,619,913 | 11/1971 | Albrecht | 63/15.7 X |
| 4,076,106 | 2/1978 | Bermingham et al. | 24/681 X |

FOREIGN PATENT DOCUMENTS

| | | | |
|---|---|---|---|
| 590817 | 1/1960 | Canada | 63/15.7 |
| 718154 | 9/1965 | Canada | 63/15.7 |
| 64466 | 4/1913 | Switzerland | 24/681 |
| 1016636 | 1/1966 | United Kingdom | 24/589 |

*Primary Examiner*—Kenneth J. Dorner
*Assistant Examiner*—James R. Brittain
*Attorney, Agent, or Firm*—Zarley, McKee, Thomte, Voorhees & Sease

[57] ABSTRACT

A ring shank comprising pivotal shank portions pivoted together at one end thereof. The free ends of the shank portions are provided with a ball and socket joint connection which releasably hold their portions in the closed position. A locking clasp is pivotally secured to one of the shank portions and may be pivotally moved so as to embrace the free ends of the shank portions to maintain the portions in their closed position.

2 Claims, 1 Drawing Sheet

RING SHANK

BACKGROUND OF THE INVENTION

In previous ring constructions of conventional design, a problem exists in sliding a ring of a fixed internal diameter over the knuckles or joints of arthritic fingers or the like. Many types of segmented rings or ring shanks have been previously provided but have experienced several disadvantages. For example, in U.S. Pat. No. 2,771,753, the yokes which are pivotally mounted on the tongues of the main portion of the ring, as well as the safety clasp, objectionally protrude from the sides of the ring and can become caught on items of wearing apparel. Further, the projections detract from the aesthetic appearance of the ring.

In other ring constructions, there is no secure locking means for ensuring that the pivoted ring shank portions will remain closed. Additionally, the prior art devices, when opened and closed frequently, experience excessive wear.

Therefore, it is the principal object of the invention to provide an improved ring shank.

A further object of this invention is to provide an adjustable or segmented ring shank which may be opened to be slipped over enlarged knuckles or joints.

A further object of the invention is to provide a ring shank of the type described which includes a secure locking means for maintaining the ring shank in its closed position.

Still another object of the invention is to provide a ring shank of the type described which does not have any projections or protrusions.

Yet another object of the invention is to provide a ring shank having an expandable socket which prevents excessive wear.

Yet another object of the invention is to provide a ring shank which is aesthetically attractive.

These and other objects will be apparent to those skilled in the art.

SUMMARY OF THE INVENTION

Figure 1:
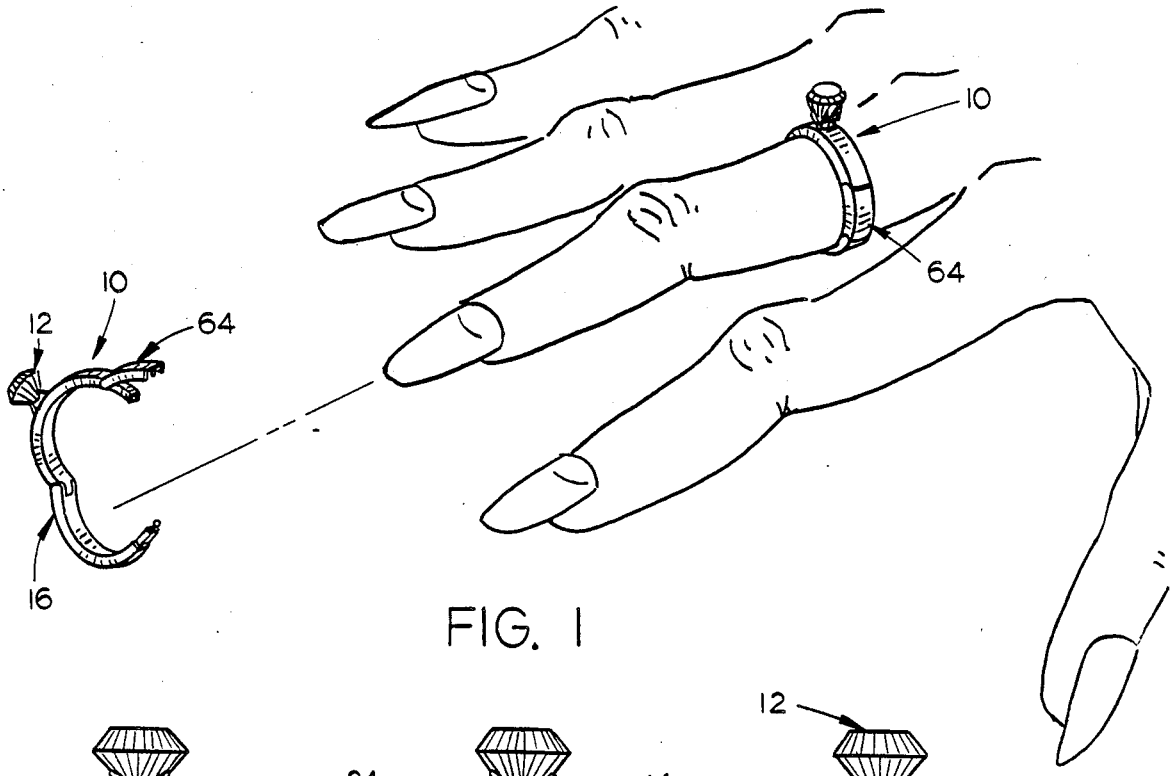
FIG. 1 is perspective view illustrating the ring shank of this invention in an opened position and also in a closed position on a person's finger.

A ring shank is provided which is comprised of two semi-circular shank portions which are pivoted together to enable the ring shank to be pivotally moved from a closed position to an opened position so that the ring shank may be slipped onto a finger or slipped therefrom when in the open position. One of the shank portions includes a ball projecting from the free end thereof which is adapted to be received in an expandable socket in the free end of the other ring shank portion. A locking clasp is pivotally secured to the ring shank portion and is adapted to be moved to a position where it embraces the free ends of both of the ring shank portions. The locking clasp prevents the ball from inadvertently being pulled from the expandable socket when the clasp is in its locked position.

DESCRIPTION OF THE PREFERRED EMBODIMENT

The ring shank of this invention is referred to generally by the reference numeral 10 and is shown to have a setting 12 mounted thereon although settings may not always be utilized, as for example, in a plain wedding band.

Figure 2:
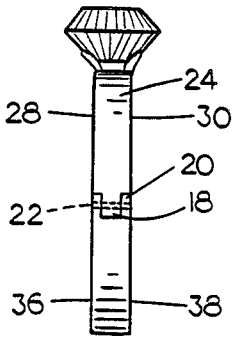
FIG. 2 is an end elevational view of the ring shank of this invention.

Shank 10 is comprised of two semi-circular shank portions or segments 14 and 16. One end of shank portion 16 is provided with a projecting shoulder 18 which is received within yoke 20 of shank portion 16, as illustrated in FIG. 2. Transversely extending pin 22 pivotally secures the shank portions 14 and 16 together. It can be seen in FIG. 2 that there are no projections extending from the ring shank 10 at the pivotal connection of the shank portions 14 and 16. It can be seen in the drawings that both of the shank portions 14 and 16 have quadrilateral cross-sections. For purposes of description, shank portion 14 will be described as having an outer surface 24, inner surface 26, and opposite sides 28 and 30. Shank portion 16 will likewise be described as including an outer surface 32, inner surface 34, and opposite sides 36 and 38.

Shank portion 16 is provided with a stub 40 projecting from the free end thereof. As seen in the drawings, stub 40 is narrower than shank portion 16 so that the sides 42 and 44 of stub 40 are recessed relative to the sides 36 and 38, respectively. The outer surface 46 of stub 40 is also recessed relative to outer surface 32 of shank portion 16. Stub 40 is provided with a bore 48 extending inwardly into the outer surface thereof as illustrated in the drawings. Shaft 50 projects from the free end of stub 40 and has a ball 52 mounted on the outer end thereof which is preferably white gold for longer lasting wear. The inventor, based on his experience as a goldsmith and designer, has configured this mechanism with primary emphasis on maximizing its resistance to wear. It has likewise been designed to accommodate any style ring, from the simple shank to the larger style rings.

Shank portion 14 is also provided with a stub 54 projecting from the free end thereof which is complimentary in cross-sectional configuration to stub 46. Stub 54 is provided with a socket joint 56 which is defined by bore 58 extending inwardly into the free end of stub 54 and slots 60 and 62 to permit the socket joint to be expandable. Bore 58 is adapted to receive ball 52 with the slots 60 and 62 permitting the separation of the end of the stub 54 to permit the ball 52 to enter bore 58 and to permit the removal of the same without creating excessive wear on either portions of the joint.

Figure 3:
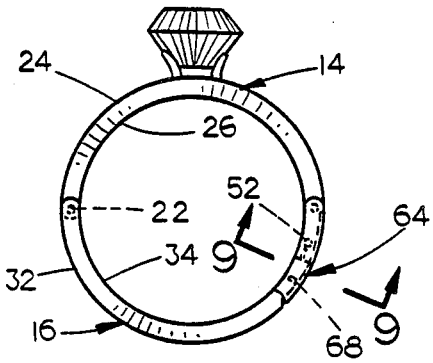
FIG. 3 is a side elevational view of the ring shank of this invention.
Figure 4:
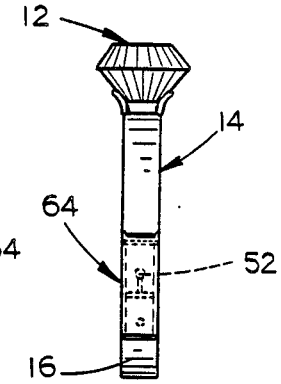
FIG. 4 is an end elevational view of the ring shank taken opposite to that of FIG. 2.
Figure 9:
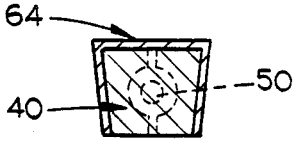
FIG. 9 is a sectional view seen on lines 9—9 of FIG. 3.
Figure 8:
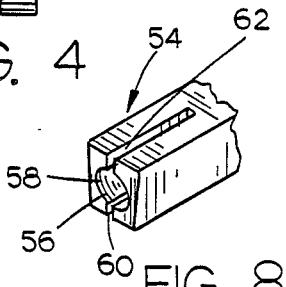
FIG. 8 is a partial perspective view of the socket.
Figure 5:
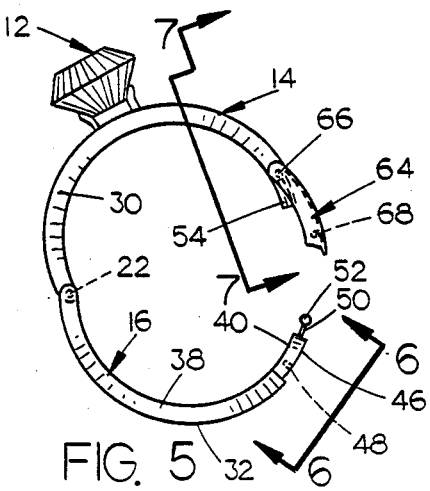
FIG. 5 is a view similar to FIG. 3 except that the ring has been moved to its open position.
Figure 6:
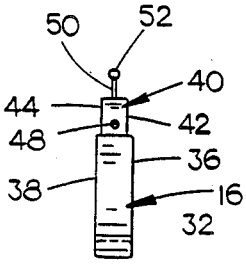
FIG. 6 is a view as seen on Line 6—6 of FIG. 5.
Figure 7:
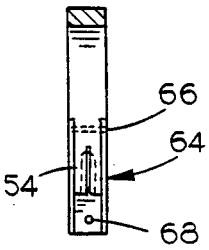
FIG. 7 is a sectional view as seen on Line 7—7 of FIG. 5.

A substantially U-shaped clasp 64 is pivotally connected to stub 54 by pin 66 in such a manner so that the sides of the clasp 64 do not project outwardly from the sides of the shank portions. As seen in the drawings, clasp 64 is adapted to be pivoted to the open position as seen in FIG. 5 or to the closed position as illustrated in FIG. 3. When in the closed position as seen in the drawings, clasp 64 embraces stubs 40 and 54. Clasp 64 is provided with an inwardly projecting pin 68 which is adapted to be received by bore 48 when the shank is closed and the clasp 64 is pivoted to its closed or locked position. As best seen in FIG. 9, the sides of clasp 64 are tapered, as are stubs 46 and 54, to provide a secure locking action.

If a person has trouble slipping the ring 10 over joints or knuckles of a particular finger, the shank may be opened by first pivotally moving clasp 64 to the open position. Shank portion 16 is then pulled pivoted relative to shank portion 14 so that ball 52 is pulled from socket 56. The ring is then slipped over the finger and shank portion 16 pivoted relative to shank portion 14 so that ball 52 is initially received by the bore 58. As the ball 52 enters bore 58, the slots 60 and 62 permit the sides of the stub 54 to move outwardly so that excessive wear will not be imposed on the joint. When the ball 52 has been inserted into the socket 56, clasp 64 is pivotally moved to the closed or locked position so that pin 68 is received in bore 48.

When the clasp 64 has been moved to its locked position, the engagement of pin 68 in bore 48 prevents separation of the shank portions. The separation is further prevented by the fact that the sides of the clasp 64 prevent the sides of stub 54 from moving outwardly about the slots 69 and 62 by retaining ball 52 in the socket 56.

Construction of the shank just described is such that the shank may be easily opened and closed with a minimum of effort. Further, there are no projections needed by the construction of the shank which could catch on clothing or the like. Further, the construction of the joint is such that the ring will remain securely in its closed position due to the interrelationship of the various component parts. Hence, it can be seen that the shank of this invention accomplishes at least all of its stated objectives.

I claim:

1. A ring shank, comprising, a first, elongated, arcuate shank portion having first and second ends, a second, elongated, arcuate shank portion having first and second ends, each of said first and second shank portions having a quadrilateral cross section with inner, outer and opposite side surfaces, means pivotally connecting said first ends of said first and second shank portions, each of said first and second shank portions being generally semicircular in shape so as to form a complete circular ring shank when said second ends are pivoted into abutting relation, a first stub portion extending from said second end of said first shank portion, said first stub portion having a quadrilateral cross section with inner, outer and opposite side surfaces, the opposite side surfaces of said first stub portion being spaced inwardly of said opposite side surfaces of said first shank portion, the outer surface of said first stub portion being spaced inwardly of the outer surface of said first shank portion, a shaft portion extending from said first stub portion, a ball member mounted on said shaft portion, said first stub portion having a bore formed therein which extends inwardly into the outer surface thereof, a second stub portion extending from said second end of said second shank portion and having inner, outer, and opposite side surfaces, said second stub portion having a bore formed in its end and extending inwardly therein, said second stub portion further having a pair of opposing slots formed in its end bisecting the bore to form an expansion socket which is adapted to detachably, frictionally receive said ball member therein at times to enable said first and second shank portions to form a circular ring shank, an elongated U-shaped clasp pivotally connected at one end thereof to said second stub portion and being pivotally movable from an unlocked position to a locked position, said U-shaped clasp comprising an outer wall member having opposite side walls extending inwardly therefrom, the exterior surfaces of said side walls being flush with the opposite side surfaces of said first and second ring shank portions, and the exterior surfaces of said outer wall being flush with the outer surfaces of said first and second shank portions when said clasp is in said locked position.

said clasp embracing said first and second stub portions when in its said locked position to prevent the expansion of said expansion socket, and a pin extending from said clasp which is received by said bore in said first stub portion when said clasp is in its locked position to prevent the separation of said ball member from said socket.

2. The ring shank of claim 1 wherein said walls of said clasp converge inwardly from said outer wall member for frictional engagement with said stub portions, and wherein the side surfaces of said stub portions converge inwardly.

* * * * *